US006564877B1

(12) United States Patent
Ewers et al.

(10) Patent No.: US 6,564,877 B1
(45) Date of Patent: May 20, 2003

(54) AUTOMATIC VALVE WITH MANUAL OVERRIDE FOR FIRE ENGINE HIGH PRESSURE WATER SYSTEM

(75) Inventors: Ronald L. Ewers, Ocala, FL (US); Bradley A. Ewers, Ocala, FL (US); Gregory S. Thompson, Gainesville, FL (US)

(73) Assignee: Class 1, Inc., Ocala, FL (US)

( * ) Notice: Subject to any disclaimer, the term of this patent is extended or adjusted under 35 U.S.C. 154(b) by 11 days.

(21) Appl. No.: 09/728,341

(22) Filed: Dec. 1, 2000

(51) Int. Cl.[7] ..... A62C 27/00; A62C 37/36

(52) U.S. Cl. ..... 169/24; 169/19; 169/20; 239/569; 239/570; 239/571

(58) Field of Search ..... 169/19, 20, 24; 239/569, 570, 571; 137/460, 557, 517

(56) References Cited

U.S. PATENT DOCUMENTS 995,401 A 6/1911 Cheney
1,357,982 A * 11/1920 House
1,850,117 A 3/1932 McMillan
2,806,484 A * 9/1957 Schultz
2,905,432 A 9/1959 Mercier
3,289,686 A * 12/1966 Tyler, Jr.
4,231,386 A 11/1980 Braukmann
4,243,064 A 1/1981 Nolte
4,580,596 A 4/1986 Stehling
5,888,051 A 3/1999 McLoughlin et al.

* cited by examiner

*Primary Examiner*—Robin O. Evans
(74) *Attorney, Agent, or Firm*—Allen, Dyer, Doppelt, Milbrath & Gilchrist, P.A.

(57) ABSTRACT

An apparatus and method for releasing pressure and draining a high pressure water system includes a valve comprising a valve body having an inner cavity for water to flow therethrough, an inlet opening and an outlet opening in fluid connection with the inner cavity, a valve seat assembly comprising a first biasing member exerting a force against a valve plunger cooperating with a seal to thereby substantially close the valve at or above a predetermined system pressure, and an override comprising a manual activator having a second biasing member and a cooperating member positioned to transmit to said valve seat assembly a force applied by an operator, to thereby manually open the valve when pressure exceeds the predetermined system pressure.

34 Claims, 2 Drawing Sheets

AUTOMATIC VALVE WITH MANUAL OVERRIDE FOR FIRE ENGINE HIGH PRESSURE WATER SYSTEM

FIELD OF THE INVENTION

The present invention relates to the field of high pressure water systems and, more particularly, to a high pressure water system in a fire-fighting apparatus such as a fire engine.

BACKGROUND OF THE INVENTION

A fire-fighting apparatus, such as a fire engine, requires a high pressure water system to provide sufficient force for projecting a stream of water from a fire hose a certain distance to the fire. These high pressure water systems usually operate at up to approximately 600 pounds per square inch (p.s.i.) of pressure. The pumper fire engine will normally include a centrifugal impeller pump for generating the high water pressure needed for fire-fighting. The fire engine's high pressure water system will generally be connected to a low pressure source of water such as a fire hydrant, or even a no pressure source such as a pond. Multiple fire hoses are connected to the high pressure water system in the fire engine, and are used to discharge streams of water under relatively high pressure. The discharge pressure of a stream of water from such a fire hose is often sufficiently high that it requires more than one fire fighter to control the hose nozzle.

When fire fighters are finished extinguishing a fire, the pump in the fire engine is shut off and the hoses are left open until the pressure in the system drops to a relatively low level. The fire engine pump valves are then closed, and the fire hoses are disconnected from the fire engine water system. At this point, however, there usually remains some residual pressure in the fire engine's water system, and this pressure should be released. The usual procedure is for an operator to open a manual pressure release valve located on the fire engine. Alternatively, the fire engine may be equipped with an automatically opening pressure release valve which will be self opening when water pressure in the line drops below a predetermined level, such as when fire fighters leave hose nozzles open to release pressure. There are times, however, when circumstances do not allow for the hoses to be left open for a sufficient time to release pressure, and pressure in the lines remains above the level required for an automatic valve to open. Further, manually operated valves must also be manually reset to their closed position before fire fighting operations resume, requiring operator intervention.

SUMMARY OF THE INVENTION

In view of the foregoing, the present invention advantageously provides a valve comprising both manual and automatic operation for releasing residual pressure in the fire engine's high pressure water system would render several useful functions. During start up of the water pump, the valve would be opened manually to vent air from the high pressure water lines to help prevent cavitation, or the pump from losing its prime. Upon shutdown of the system and opening of the hose nozzles, the valve would open automatically when pressure dropped sufficiently, thus draining water remaining in the fire engine's water system so as to help keep the fire engine's interior lines clean. If fire hose nozzles cannot be left open to relieve pressure upon system shutdown, then the valve could be opened manually to relieve residual pressure so that the fire hoses can be safely disconnected, and to prevent the fireman disconnecting the hoses from being thoroughly drenched by water spraying under pressure when a hose connection is broken. The valve is additionally useful since it does not require manual reset to a closed position. when opened manually. The present valve, therefore, provides the advantages of opening automatically and manually, and of requiring no operator intervention to close the valve when opened manually.

The valve comprises a valve body having an inner cavity for water to flow therethrough. An inlet opening on the valve body is in fluid connection with the inner cavity to permit fluid flow thereinto. An outlet opening on the valve body is positioned in fluid connection with the inner cavity to permit fluid flow therefrom. A valve seat assembly is positioned in the inner cavity and comprises a first biasing member exerting a force against a valve plunger cooperating with a seal to thereby close the valve at or above a predetermined system pressure and substantially stop fluid flow through the outlet opening. The valve also includes an override comprising a manual activator having a second biasing member and a cooperating member positioned to transmit to said valve seat assembly a force applied by an operator, to thereby open the valve when pressure exceeds the predetermined system pressure.

The valve disclosed in the present invention is advantageously used in combination with a fire engine high pressure water system. Additionally, a high pressure water system having the disclosed valve is claimed as part of the invention. It should be understood, however, that the disclosed valve and method may be employed in any high pressure water system having similar requirements as that in a fire engine, and is not limited to just a fire engine's high pressure water system.

The invention additionally discloses, in a high pressure water system having a water pump, a method of releasing residual pressure from the system. The method comprises shutting off the water pump, manually opening a first outlet connected to the high pressure water system until pressure drops to a predetermined level, and automatically opening a second outlet responsive to the predetermined pressure level to thereby release the residual pressure from the system.

In the method, a fire-fighting apparatus preferably comprises the high pressure water system, and the first outlet comprises a fire hose. In another embodiment of the method, the predetermined level of pressure is approximately 6 p.s.i. Also, the second outlet comprises a drain valve which opens responsive to a predetermined system pressure of approximately 6 p.s.i. or less. The method additionally provides that the drain valve may be opened manually above the predetermined system pressure.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

Figure 2:
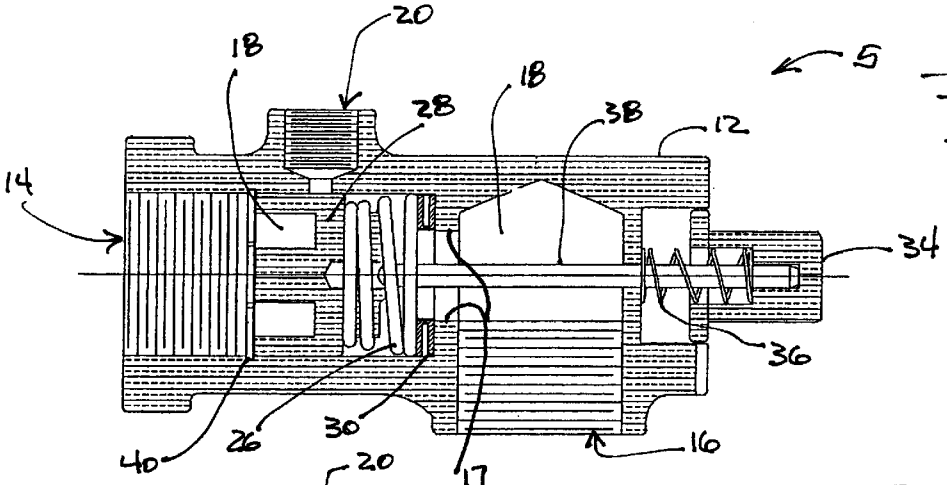
FIG. 2 is a cross sectional view of the valve of FIG. 1, along the line A–A'.
Figure 1:
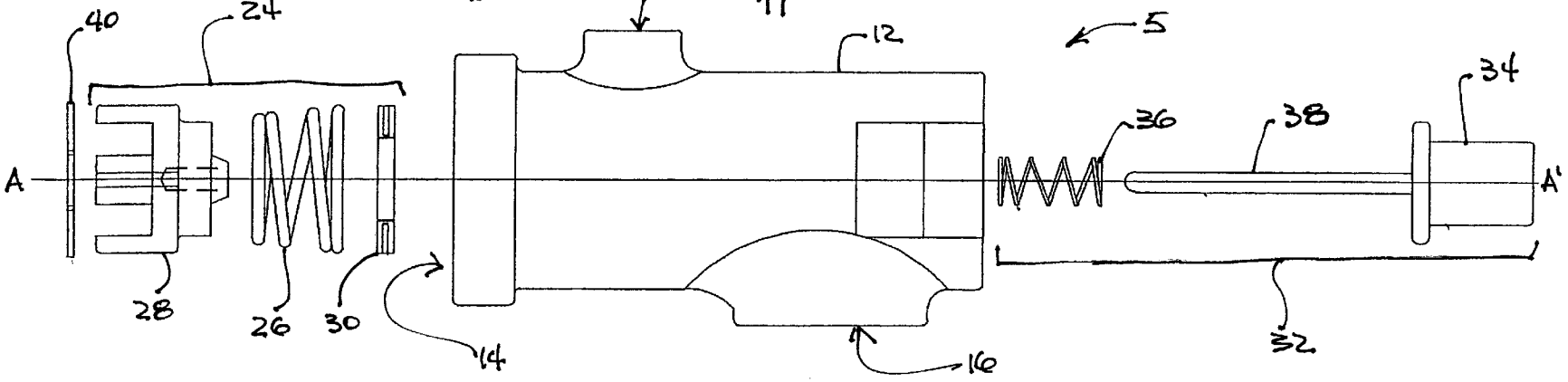
FIG. 1 is an exploded side view of the valve according to an embodiment of the present invention.
Figure 3:
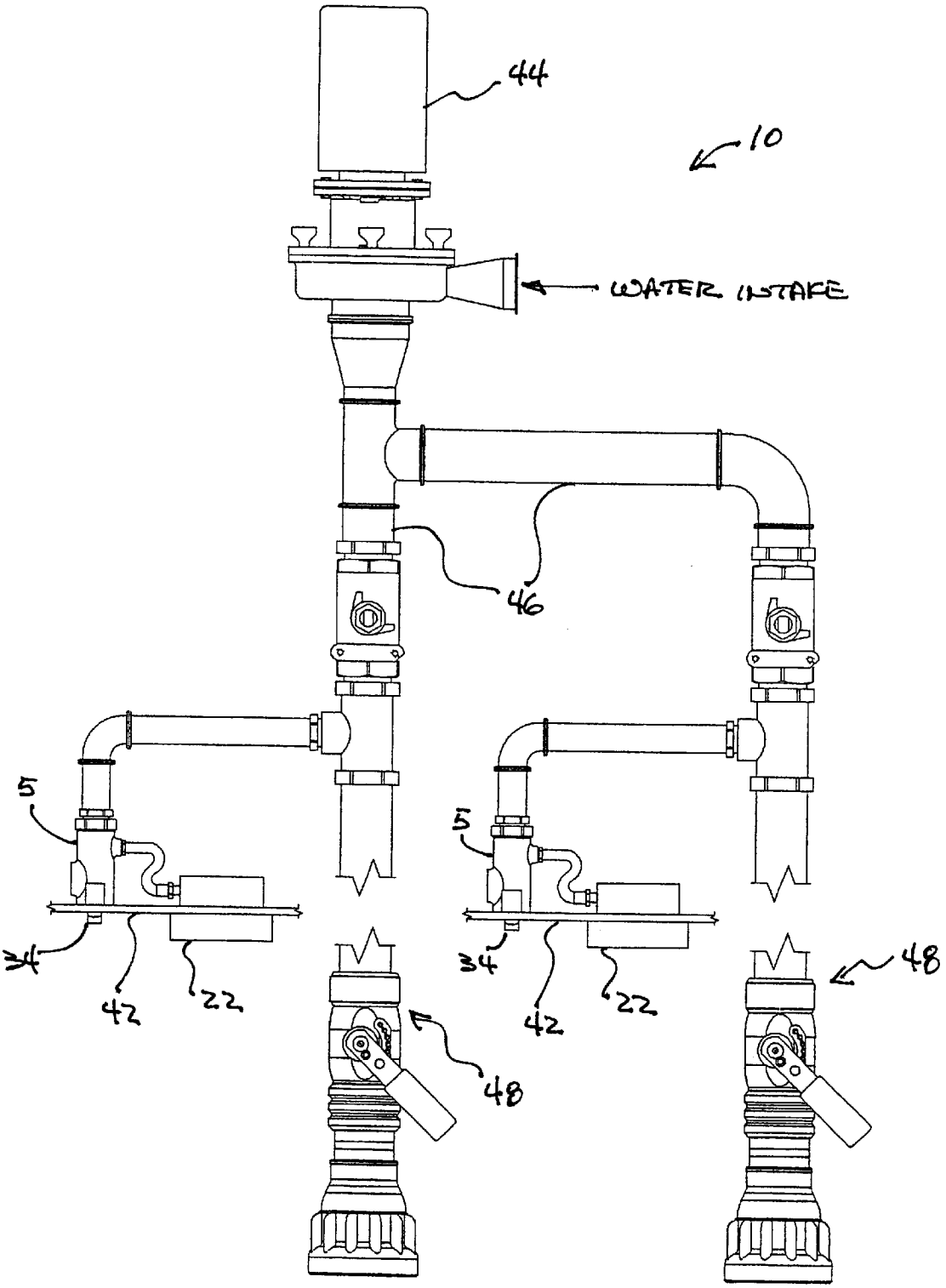
FIG. 3 illustrates a schematic diagram of a typical high pressure water system in a fire engine, the system comprising the valve of FIG. 1.

FIGS. 1 through 3 illustrate a valve 5 for a high pressure water system 10. The high pressure water system 10 is preferably that employed in a fire engine. As shown in FIGS. 1–2, the valve 5 comprises a valve body 12 having an inner cavity for water to flow therethrough. The valve 5 must be fabricated of a material sufficiently strong to withstand the high operating pressures of a fire engine's water system 10, and is preferably of machined metal. The valve 5 includes an inlet opening 14 in fluid connection with the inner cavity to permit fluid flow thereinto, and an outlet opening 16 in fluid connection with the inner cavity 18 to permit fluid flow therefrom. When open, as shown in FIG. 2, the valve 5 allows for fluid release from the water system 10 through the valve's outlet 16. In an additional embodiment, the valve 5 comprises a meter opening 20 positioned on the valve body 12 in fluid connection with the inner cavity 18 for connecting a pressure meter 22 thereto. A valve seat assembly 24 is positioned adjacent the inlet opening 14, and comprises a first biasing member 26 and a plunger 28 cooperating with a seal 30 to substantially stop fluid flow through said outlet 16. The valve seat assembly 24 is responsive to fluid pressure within the inner cavity 18 to thereby close the valve 5. The valve 5 also includes an override 32 having a manual activator 34, a second biasing member 36, and a cooperating member 38 to transmit to the valve seat assembly 24 a force applied by an operator, thereby opening the valve.

The valve 5 of the present invention provides two operating modes, manual operation when an operator applies force to the override 32 to open the valve, and automatic operation responsive to pressure in the water system 10 wherein the valve opens or closes at a predetermined pressure. The valve assembly 24 is responsive to fluid pressure within the inner cavity 18 so as to open the valve 5 when fluid pressure is approximately 6 p.s.i. or less, as illustrated in FIG. 2. Additionally, the valve seat assembly 24 is similarly responsive to fluid pressure within the inner cavity 18 so as to automatically close the valve 5 when fluid pressure exceeds approximately 6 p.s.i. by plunger 28 moving in response to the fluid pressure to abuttingly contact seal 30, thereby substantially stopping fluid flow through the outlet opening 16.

In a preferred embodiment of the valve 5, as shown in FIGS. 1–2, the seal 30 comprises a synthetic material reinforced with metal, and more particularly, comprises rubber-coated metal. Additionally, the inlet 14 and the outlet 16 are best provided with threads for connecting the valve 5 to the high pressure water system 10. A retainer 40 is positioned within the inner cavity 18 of the valve 5 to retain the valve seat assembly 24 therein, preventing it from being expelled from the valve 5 through the inlet opening 14 due to the pressure. The retainer 40 most advantageously comprises a snap ring positioned in the inner cavity 18 between the valve seat assembly 24 and said inlet opening 14. Plunger 28 comprises the valve seat itself, which abuttingly contacts seal 30 when the valve is in the closed position. The valve seat assembly 24 is prevented from being expelled from valve 5 through outlet opening 16 by a flange 17 formed in the inner cavity 18 between the inlet opening 14 and the outlet opening. Through the biasing action of the first biasing member 26, the valve seat assembly 24 operates responsively to fluid pressure in the inner cavity 18 opening and closing the valve 5 at predetermined fluid pressures without operator intervention, that is, automatically. Preferably, the fluid pressures opening and closing the valve 5 are approximately equal, and most preferably approximately 6 p.s.i. The high pressure water system 10 wherein the valve 5 of the present invention is employed is intended to operate at up to approximately 600 p.s.i. of water pressure.

Additional features in alternative embodiments of the drain valve 5 include wherein the manual activator 34 comprises a push button, and the cooperating member 38 in the override 32 includes a connecting rod between the manual activator and the valve seat assembly 24. It should be understood, however, that the manual activator 34 could also include other manually operated devices such as a screw or bolt device connected to move the valve seat off the seal 30 to thereby open the valve 5. The manually activated override 32 resets the valve seat assembly 24 to a closed position when fluid pressure is approximately 6 p.s.i. or more and operator intervention ends.

An additional aspect of the claimed invention includes the valve 5 described in detail above, in combination with a fire engine having a high pressure water system 10. In this embodiment of the invention, shown schematically in FIG. 3, the valve 5 is preferably mounted on a control panel 42 on the fire engine along with other controls for the high pressure water system 10, so as to be accessible to a fire engine operator. The valve inlet 14 is connected to the fire engine's high pressure water system 10 and the outlet 16 provides a drain to outside. A pressure meter 22 is in communication with the inner cavity 18 of the valve 5 by being connected to the valve at the meter opening 20, to thereby provide the operator a measure of the pressure within the water system 10.

A further aspect of the invention is a high pressure water system 10 having a valve 5 comprising a pressure resistant valve body 12, and the characteristics and structure described. The high pressure water system 10 comprises a water pump 44, at least one conduit 46 for conducting water, and the valve 5 of the present invention, as described above. The high pressure water system 10 is preferably positioned in a fire engine, and the valve 5 is preferably mounted on a control panel 42 on the fire engine for easy access by a fire engine operator. The high pressure water system 10 preferably also comprises a pressure meter 22 connected to a meter opening 20 positioned on the valve body 12 in connection with the inner cavity 18.

Another aspect of the invention includes, in a high pressure fluid system 10 having a pump 44 and at least one water conduit 46 connected to the pump, a method of releasing residual fluid pressure upon shutdown of the system. The method comprises shutting off the pump 44, manually opening a first outlet connected to the conduit 46 until fluid pressure drops to a predetermined level, and automatically opening a second outlet connected to the conduit responsive to the predetermined level of fluid pressure to thereby release the residual pressure from the system 10. In the method, preferably a fire-fighting apparatus comprises the high pressure fluid system 10. Likewise, the first outlet in the method preferably comprises a fire hose 48. The predetermined level of fluid pressure in the method preferably is approximately 6 p.s.i. The second outlet 16 comprises a drain valve 5 which opens responsive to a predetermined system fluid pressure of preferably approximately 6 p.s.i. or less, but which may be opened manually above the predetermined system pressure by use of the activator 34.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. In combination with a fire engine having a high pressure water system, a valve in fluid connection with the high pressure water system, said valve comprising:

a valve body having an inner cavity for water to flow therethrough;

an inlet opening in fluid connection with the inner cavity to permit water flow thereinto;

an outlet opening in fluid connection with the inner cavity to permit water flow therefrom;

a valve seat assembly positioned in the inner cavity and comprising a first biasing member exerting a force on a valve plunger cooperating with a seal to thereby open the valve approximately at or below a predetermined system pressure to allow water flow through said outlet opening; and an override comprising a manual activator having a second biasing member and a cooperating member positioned to actuate said valve seat assembly to an open position responsive to a force applied to the manual activator, to thereby open the valve when pressure exceeds the predetermined system pressure.

2. The valve of claim 1, wherein said valve is mounted on a control panel on the fire engine so as to be accessible to a fire engine operator.

3. The valve of claim 1, wherein said inlet is connected to the fire engine's high pressure water system and said outlet provides a drain to outside.

4. The valve of claim 1, further comprising a meter opening positioned on said valve body in fluid connection with the inner cavity, and a pressure meter connected thereto.

5. The valve of claim 1, wherein said valve seat assembly operates responsive to water pressure within the inner cavity so as to open said valve when water pressure is approximately 6 p.s.i. or less, thereby allowing water to flow through said outlet opening.

6. The valve of claim 1, wherein said valve seat assembly operates responsive to water pressure within the inner cavity so as to close said valve when water pressure exceeds approximately 6 p.s.i. to thereby substantially stop water flow through said outlet opening.

7. The valve of claim 1, wherein the seal comprises a synthetic material reinforced with metal.

8. The valve of claim 1, wherein the seal comprises rubber coated metal.

9. The valve of claim 1, wherein said inlet opening and outlet opening further comprise threads connecting said valve in the water system.

10. The valve of claim 1, further comprising a retainer positioned within the inner cavity to retain said valve seat assembly therein.

11. The valve of claim 10, wherein the retainer comprises a snap ring positioned in the inner cavity between said valve seat assembly and said inlet opening.

12. The valve of claim 1, wherein the valve seat assembly functions responsively to water pressure in the inner cavity to open and close said valve at predetermined water pressures.

13. The valve of claim 7, wherein the water pressures for opening and closing said valve are approximately equal.

14. The valve of claim 1, wherein the high pressure water system operates at up to approximately 600 p.s.i. of water pressure.

15. The valve of claim 1, wherein the manual activator comprises a push button.

16. The valve of claim 1, wherein the cooperating member in the override comprises a connecting rod positioned to actuate the valve seat assembly when a force is applied to the manual activator.

17. The valve of claim 1, wherein the manually controlled override resets the valve seat assembly to a closed position when water pressure is approximately 6 p.s.i. or more and the applied force ends.

18. A high pressure water system comprising:

a high pressure water pump;

at least one conduit in fluid connection with said high pressure water pump for conducting water; and a valve in fluid connection with said at least one conduit, said valve comprising a valve body having an inner cavity for water to flow therethrough, an inlet opening connected to the inner cavity to permit water flow thereinto, an outlet opening connected to the inner cavity to permit water flow therefrom, a valve seat assembly positioned in the inner cavity and comprising a first biasing member exerting a force on a valve plunger cooperating with a seal to thereby open the valve at or below a predetermined system pressure allowing water flow through said outlet opening, and an override comprising a manual activator having a second biasing member and a cooperating member positioned to transmit an applied force to the valve seat assembly to thereby open the valve when water pressure exceeds the predetermined system pressure.

19. The system of claim 18, wherein said system is positioned in a fire engine, and said valve is accessible to a fire engine operator.

20. The system of claim 19, wherein the inlet opening of the valve is connected to the fire engine's high pressure water system and the valve's outlet provides a drain to outside.

21. The system of claim 18, further comprising a pressure meter connected to a meter opening positioned on the valve body in connection with the inner cavity.

22. The system of claim 18, wherein said valve seat assembly is responsive to water pressure within the inner cavity so as to open said valve when water pressure is approximately 6 p.s.i. or less to thereby allow water flow from said inlet opening to said outlet opening.

23. The system of claim 18, wherein the valve seat assembly is responsive to water pressure within the inner cavity so as to close said valve when water pressure exceeds approximately 6 p.s.i. to thereby substantially stop water flow from said inlet opening to said outlet opening.

24. The system of claim 18, wherein the seal comprises a synthetic material reinforced with metal.

25. The system of claim 18, wherein the seal comprises rubber coated metal.

26. The system of claim 18, wherein said inlet opening and outlet opening further comprise threads for connecting said valve to said at least one conduit.

27. The system of claim 18, further comprising a retainer positioned within the inner cavity to retain said valve seat assembly therein.

28. The system of claim 27, wherein the retainer comprises a snap ring positioned in the inner cavity between said valve seat assembly and said inlet opening.

29. The system of claim 18, wherein the valve seat assembly functions responsive to water pressure in the inner cavity to thereby open and close said valve at a predetermined water pressures.

30. The system of claim 29, wherein the water pressures for opening and closing said valve are approximately equal.

31. The system of claim 18, wherein the high pressure water system operates at up to approximately 600 p.s.i. of pressure.

32. The system of claim 18, wherein the manual activator comprises a push button.

33. The system of claim 18, wherein the cooperating member in the override comprises a connecting rod positioned to actuate the valve seat assembly when a force is applied to the manual activator.

34. The system of claim 18, wherein the override resets the valve seat assembly to a closed position when water pressure is approximately 6 p.s.i. or more and the applied force ends.

* * * * *